US008914941B2

(12) United States Patent
Kim et al.

(10) Patent No.: US 8,914,941 B2
(45) Date of Patent: Dec. 23, 2014

(54) CYCLONE DUST COLLECTING APPARATUS AND VACUUM CLEANER HAVING THE SAME

(75) Inventors: Min-ha Kim, Gwangju (KR); Joung-soo Park, Jeonju-si (KR); Sung-tae Joo, Gwangju (KR); Hyun-ju Lee, Gwangju (KR); Dong-houn Yang, Gwangju (KR)

(73) Assignee: Samsung Electronics Co., Ltd., Suwon (KR)

( * ) Notice: Subject to any disclaimer, the term of this patent is extended or adjusted under 35 U.S.C. 154(b) by 658 days.

(21) Appl. No.: 13/067,415

(22) Filed: May 31, 2011

(65) Prior Publication Data

US 2012/0117753 A1 May 17, 2012

(51) Int. Cl.
*A47L 9/16* (2006.01)

(52) U.S. Cl.
CPC ..... *A47L 9/1633* (2013.01); *A47L 9/1641* (2013.01)
USPC ..... 15/353; 55/321

(58) Field of Classification Search
USPC ..... 15/347, 353; 55/321
See application file for complete search history.

(56) References Cited

U.S. PATENT DOCUMENTS

| | | | | |
|---|---|---|---|---|
| 5,908,493 | A | 6/1999 | Krymsky | |
| 6,502,278 | B2 * | 1/2003 | Oh et al. | 15/353 |
| 6,766,557 | B2 * | 7/2004 | Park et al. | 15/352 |
| 6,936,095 | B2 * | 8/2005 | North | 96/403 |
| 7,556,662 | B2 * | 7/2009 | Lee et al. | 55/345 |
| 7,645,311 | B2 * | 1/2010 | Oh et al. | 55/429 |
| 7,682,412 | B2 * | 3/2010 | Oh | 55/345 |
| 8,062,398 | B2 * | 11/2011 | Luo et al. | 55/337 |
| 2003/0159411 | A1 | 8/2003 | Hansen et al. | |
| 2003/0159412 | A1 * | 8/2003 | North | 55/345 |
| 2004/0237248 | A1 * | 12/2004 | Oh et al. | 15/353 |
| 2005/0172585 | A1 * | 8/2005 | Oh et al. | 55/345 |
| 2006/0137308 | A1 * | 6/2006 | Jeong et al. | 55/337 |
| 2006/0277714 | A1 | 12/2006 | Dunning et al. | |
| 2007/0289089 | A1 * | 12/2007 | Yacobi | 15/353 |
| 2008/0172995 | A1 * | 7/2008 | Conrad | 55/345 |
| 2009/0265883 | A1 * | 10/2009 | Reed et al. | 15/353 |
| 2009/0300874 | A1 * | 12/2009 | Tran et al. | 15/353 |
| 2010/0139033 | A1 * | 6/2010 | Makarov et al. | 15/353 |
| 2012/0192378 | A1 * | 8/2012 | Bassett | 15/353 |
| 2012/0284955 | A1 * | 11/2012 | Han et al. | 15/353 |
| 2013/0232724 | A1 * | 9/2013 | Krebs et al. | 15/353 |

FOREIGN PATENT DOCUMENTS

| | | |
|---|---|---|
| CN | 101305897 | 11/2008 |
| EP | 2636348 | 9/2013 |

OTHER PUBLICATIONS

European Search Report Issued Oct. 10, 2013 in corresponding European Application No. 11189344.2.

* cited by examiner

*Primary Examiner* — Lee D Wilson
*Assistant Examiner* — Henry Hong
(74) *Attorney, Agent, or Firm* — Staas & Halsey LLP

(57) ABSTRACT

A cyclone dust collecting apparatus for a vacuum cleaner includes a first chamber; an entering passage disposed above the first chamber, the entering passage guiding outer air to form a downwardly whirling air current in the first chamber; a second chamber formed at a position higher than that of an outlet of the entering passage above the first chamber, the second chamber in which the outer air entering from the first chamber whirls; a contaminants-blocking member disposed to be spaced apart from a bottom surface of the first chamber at a center of the first chamber, the contaminants-blocking member preventing contaminants and water separated in the first chamber from moving into the second chamber; and a grill disposed inside the second chamber to be in fluid communication with an air discharging port through which clean air is discharged.

19 Claims, 9 Drawing Sheets

CYCLONE DUST COLLECTING APPARATUS AND VACUUM CLEANER HAVING THE SAME

CROSS-REFERENCE TO RELATED APPLICATIONS

This application claims the priority benefit under 35 U.S.C. §119(a) from Korean Patent Application No. 2010-0113966 filed Nov. 16, 2010 in the Korean Intellectual Property Office, the disclosure of which is incorporated herein by reference in its entirety.

BACKGROUND

1. Field

An embodiment or embodiments relate to a cyclone dust collecting apparatus. More particularly, the embodiment or embodiments relate to a cyclone dust collecting apparatus that can efficiently separate moisture from sucked air and a vacuum cleaner having the same.

2. Description of the Related Art

Generally, a cyclone dust collecting apparatus usable for a vacuum cleaner has a high efficiency for separating contaminants such as dust from sucked air using a centrifugal force. However, when moisture (or water) is sucked with air, a moisture separating efficiency of the cyclone dust collecting apparatus is low, for example, less than 80%. It seems that the moisture separating efficiency is low because sucked moisture has properties to flow along a wall of the cyclone dust collecting apparatus and to be divided into minute particles.

Therefore, there are few commercial dust-collecting apparatuses having a concept of separating water using a cyclone structure that separates contaminants such as dust using a centrifugal force operating upon a rotating air current.

Further, even though a cyclone dust collecting apparatus capable of separating water has been commercialized, it has a problem that maintenance is difficult since water and contaminants are overflowed to a second cyclone or a filter so that the second cyclone or the filter is clogged or/and rotted.

For solving the problem, a wet/dry vacuum cleaner that can be used for wet cleaning and dry cleaning is provided. The vacuum cleaner uses a dust collecting apparatus or some parts for a dust collecting apparatus separately formed for each of wet cleaning and dry cleaning. Therefore, when performing wet cleaning, a user mounts the dust collecting container or some part specialized for wet cleaning to the wet/dry vacuum cleaner. Also, when performing dry cleaning, the user mounts the dust collecting apparatus or some parts specialized for dry cleaning to the wet/dry vacuum cleaner. However, since the wet/dry vacuum cleaner is required to replace the dust collecting apparatus according to a cleaning type, users feel that it is inconvenient to use the wet/dry vacuum cleaner.

Therefore, it is necessary to develop a cyclone dust collecting apparatus that uses a cyclone structure and has high water separation efficiency as well as high efficiency for separating general contaminants such as dust.

SUMMARY

An embodiment or embodiments have been developed in order to overcome the above drawbacks and other problems associated with the conventional arrangement. An aspect is to provide a cyclone dust collecting apparatus that separates contaminants and water using a cyclone structure and has high water separation efficiency and a vacuum cleaner having the same.

The above aspects and/or other features can substantially be achieved by providing a cyclone dust collecting apparatus for a vacuum cleaner, which includes a first chamber; an entering passage disposed above the first chamber, the entering passage guiding outer air to form a downwardly whirling air current in the first chamber; a second chamber formed at a position higher than that of an outlet of the entering passage above the first chamber, the second chamber in which the outer air entering from the first chamber whirls; a contaminants-blocking member disposed to be spaced apart from a bottom surface of the first chamber at a center of the first chamber, the contaminants-blocking member preventing contaminants and water separated in the first chamber from moving into the second chamber; and a grill disposed inside the second chamber to be in fluid communication with an air discharging port through which clean air is discharged. The entering passage is formed in a helical pipe shape wound at least one turn along the first chamber, and the outlet of the entering passage is formed at a position that is lower than that of an inlet of the entering passage and that is the same as or is lower than that of the contaminants-blocking member.

The entering passage may be wound approximately one-and-half turn along a circumference of the first chamber.

The first chamber and the second chamber may be in fluid communication with each other through an annular opening formed around the contaminants-blocking member.

The outlet of the entering passage may be inclined to discharge the outer air toward the bottom surface of the first chamber.

The first chamber may be formed in a lower case to have a cylindrical shape, and the second chamber may be formed in an upper case to be coupled to a top portion of the lower case.

The entering passage may be formed in a helical insert that is disposed inside the upper case, and the helical insert may include a hollow insert body having an inner diameter smaller than that of the upper case and a guiding member disposed in a helical shape on an outer circumferential surface of the insert body.

The contaminants-blocking member may be supported by a supporting member disposed at a center of the lower case.

The cyclone dust collecting apparatus may further comprise: a second cyclone disposed inside the grill; and an inner contaminants chamber disposed below the grill in the first chamber, the inner contaminants chamber to collect contaminants and water discharged from the second cyclone.

The contaminants-blocking member may be disposed at the inner contaminants chamber. The contaminants-blocking member may be formed in a skirt shape downward inclined toward the bottom surface of the first chamber.

With a cyclone dust collecting apparatus according to an embodiment with a structure as described above, since water sucked with air enters a cyclone body through an entering passage wound one and more turn, the water is efficiently separated. Since an air discharging port is formed at a separate chamber above an inlet, water moving inside the cyclone body is prevented from discharging to the air discharging port. Therefore, the water separating efficiency of the cyclone dust collecting apparatus according to an embodiment is higher than that of the conventional cyclone dust collecting apparatus.

Also, since a cyclone dust collecting apparatus according to an embodiment separates contaminants and water using a cyclone method, a single cyclone dust collecting apparatus can be used regardless of wet cleaning and dry cleaning. Therefore, it is convenient for a user to use.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

Throughout the drawings, like reference numerals will be understood to refer to like parts, components and structures.

DETAILED DESCRIPTION

Hereinafter, certain exemplary embodiments will be described in detail with reference to the accompanying drawings.

The matters defined in the description, such as a detailed construction and elements thereof, are provided to assist in a comprehensive understanding of the invention. Thus, it is apparent that the embodiment or embodiments may be carried out without those defined matters. Also, well-known functions or constructions are omitted to provide a clear and concise description of exemplary embodiments. Further, dimensions of various elements in the accompanying drawings may be arbitrarily increased or decreased for assisting in a comprehensive understanding of the invention.

Figure 1:
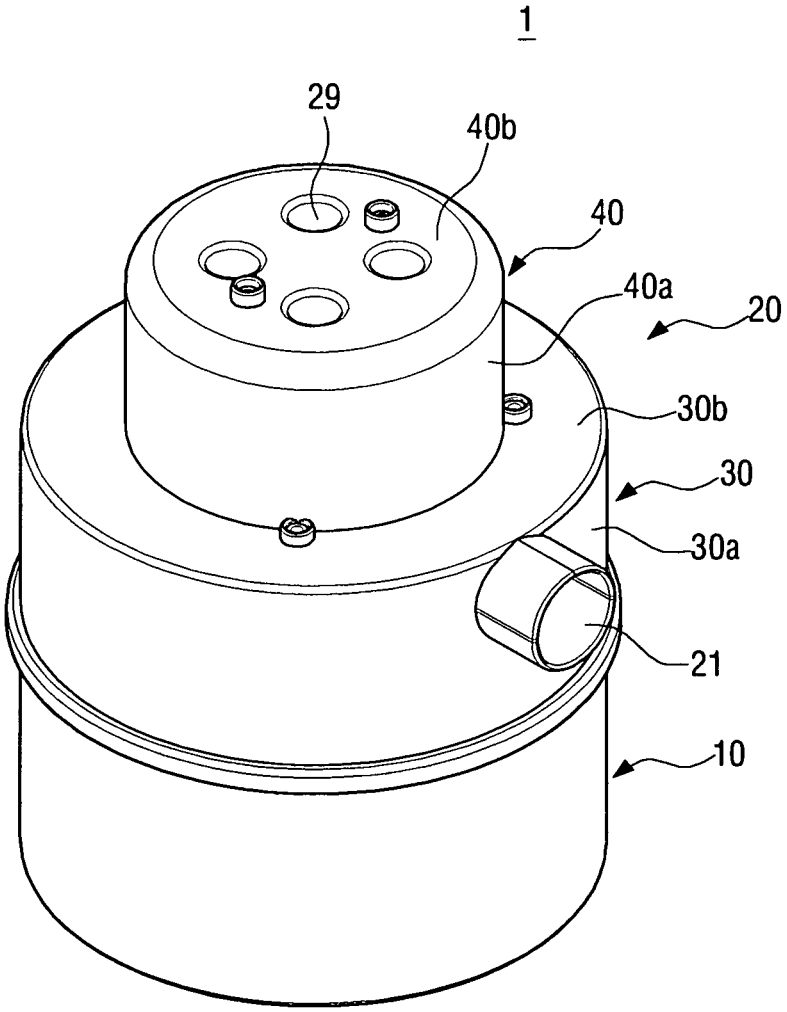
FIG. 1 is a perspective view illustrating a cyclone dust collecting apparatus for a vacuum cleaner according to an embodiment.
Figure 2:
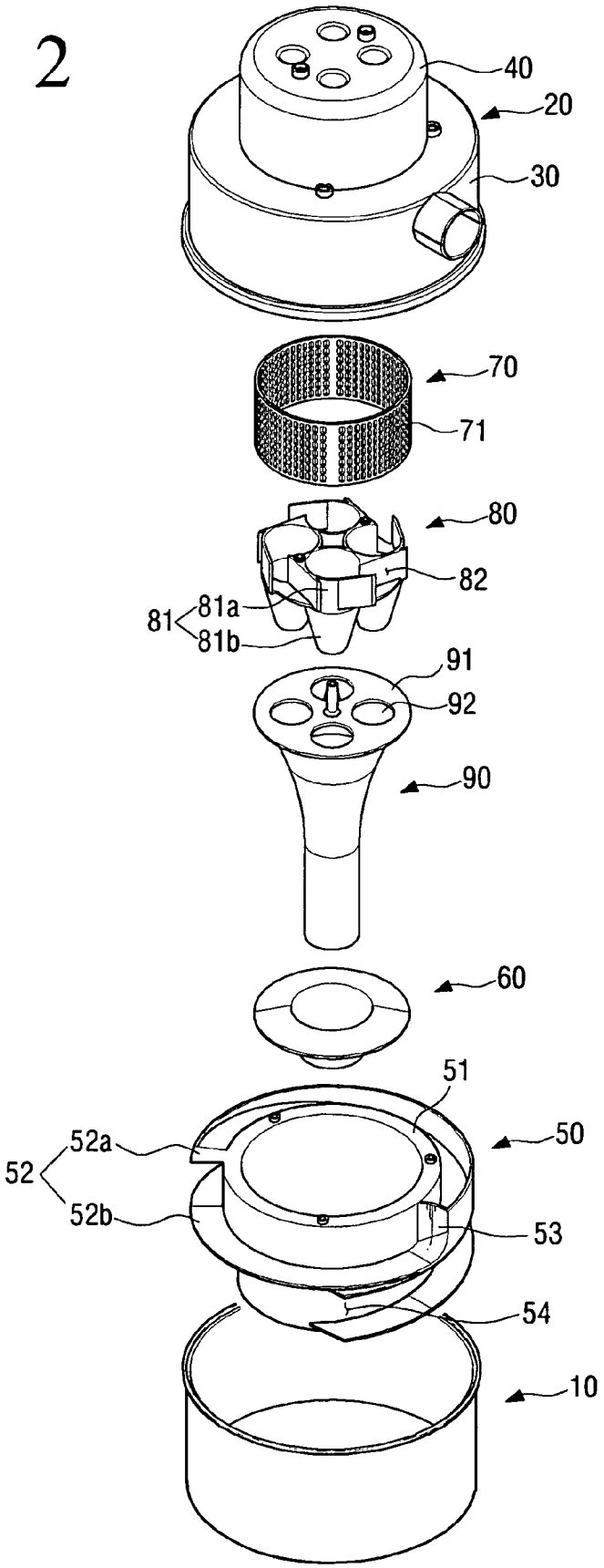
FIG. 2 is an exploded perspective view illustrating the cyclone dust collecting apparatus of FIG. 1.
Figure 3:
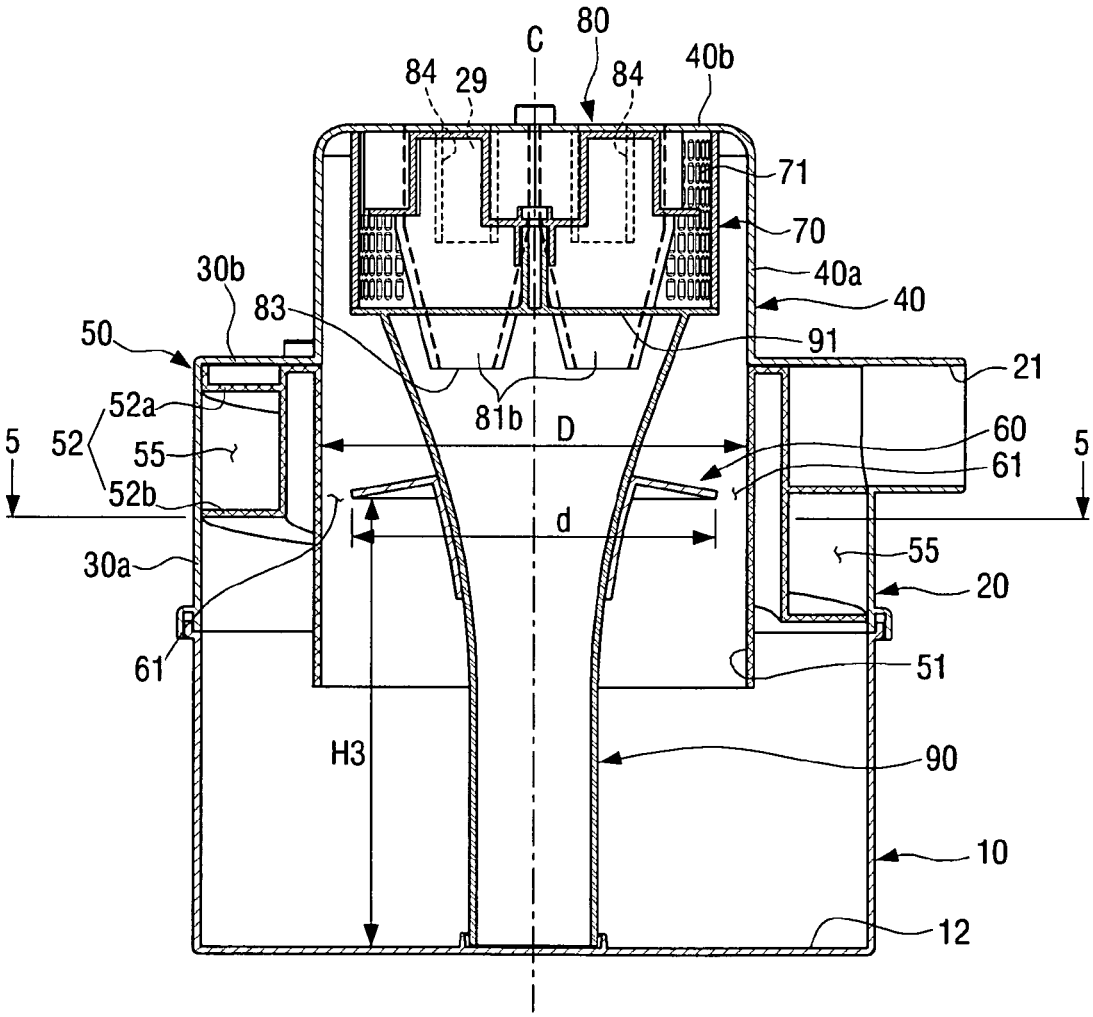
FIG. 3 is a sectional view illustrating the cyclone dust collecting apparatus of FIG. 1.

FIG. 1 is a perspective view illustrating a cyclone dust collecting apparatus for a vacuum cleaner according to an embodiment, and FIG. 2 is an exploded perspective view illustrating the cyclone dust collecting apparatus of FIG. 1. FIG. 3 is a sectional view illustrating the cyclone dust collecting apparatus of FIG. 1.

Referring to FIGS. 1 to 3, a cyclone dust collecting apparatus 1 for a vacuum cleaner an embodiment may include a first chamber 10, a second chamber 40, an entering passage 55, a contaminants-blocking member 60, and a grill 70.

The first chamber 10 forms a space in which outer air whirls. The outer air enters the first chamber 10 through the entering passage 55, and includes contaminants and water. In the first chamber 10, the contaminants and water are separated from the outer air by a centrifugal force operating upon the whirling outer air. In an embodiment, the first chamber 10 may be formed in a lower case having a hollow cylindrical shape that has an open top and a bottom surface as illustrated in FIGS. 1 to 3.

The entering passage 55 is formed in an upper portion of the first chamber 10 and guides the outer air to form a downwardly whirling air current inside the first chamber 10, namely, the lower case. In order to efficiently separate water from the entering outer air, the entering passage 55 may be formed in a pipe shape that is helically wound at least one turn along a circumference of the first chamber 10. In other words, the entering passage 55 is formed in a coil shape wound more than one turn about a center axis C of the first chamber 10. Also, the entering passage 55 may be formed in a pipe shape that is helically wound maximally approximately one-and-half turns along a circumference of the first chamber 10. Accordingly, an inlet 53 and an outlet 54 of the entering passage 55 are spaced apart from each other in a range between 360 degrees and 540 degrees with respect to the center axis C of the first chamber 10.

Figure 4:
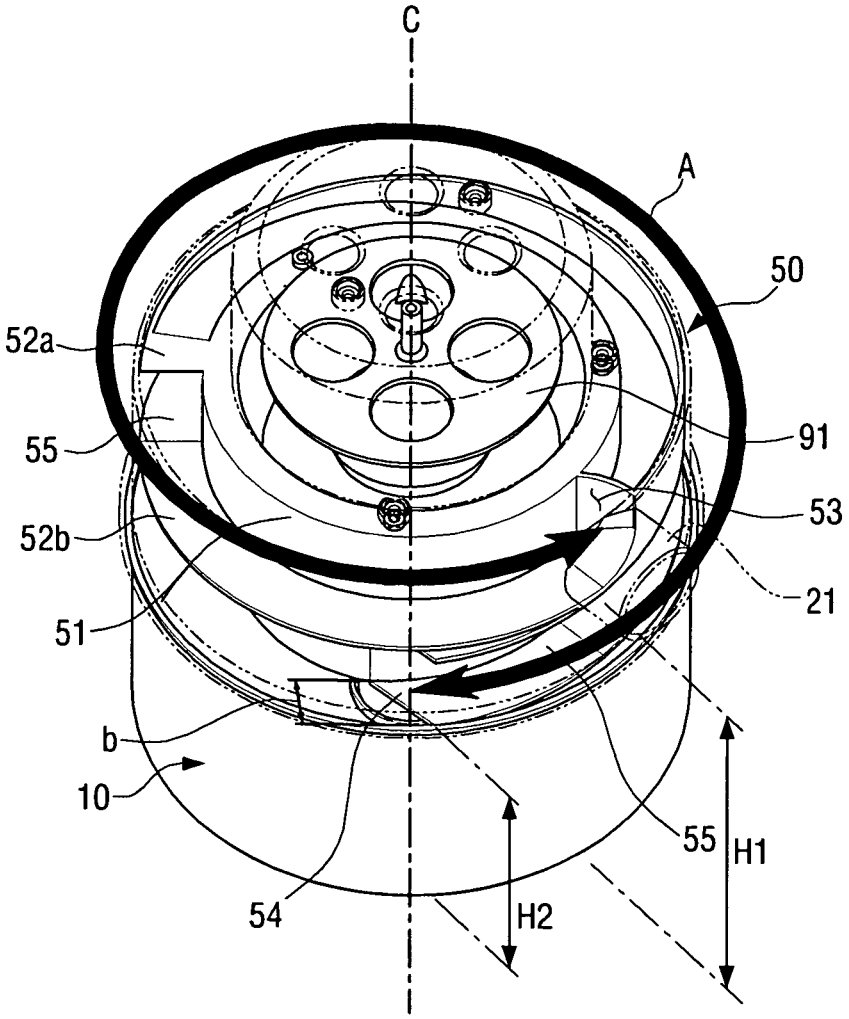
FIG. 4 is a perspective view illustrating the cyclone dust collecting apparatus in which a top part of an upper case is removed for explaining a structure of an entering passage of the cyclone dust collecting apparatus of FIG. 1.

FIG. 4 is a perspective view illustrating an entering passage 55 of a cyclone dust collecting apparatus 1 according to an embodiment. Referring to FIG. 4, the entering passage 55 is wound approximately more than one turn along a circumference of a top end of the lower case above the lower case forming the first chamber 10. Therefore, in FIG. 4, an angle A by which the outlet 54 of the entering passage 55 is spaced apart from the inlet 53 of the entering passage 55 to which an entering pipe 21 of an upper case 20 is connected is approximately 400 degrees with respect to the center axis C of the first chamber 10. Here, even though the angle A between the inlet 53 and the outlet 54 of the entering passage 55 is 400 degrees, this is only one example. However, this should not be considered as limitation.

In order to efficiently separate water from the outer air, the outlet 54 of the entering passage 55 may be formed to have a height H2 that is lower than the height H1 of the inlet 53 of the entering passage 55 and is the same as or lower than the height H3 (See FIG. 3) of the contaminants-blocking member 60. Here, the height H1 of the inlet 53 and the height H2 of the outlet 54 of the entering passage 55 are referred to a height from the bottom surface 12 of the first chamber 10, namely, the lower case, to a bottom end of the inlet 53 and to a bottom end of the outlet 54 of the entering passage 55, respectively. The height H3 of the contaminants-blocking member 60 is referred to a height from the bottom surface 12 of the first chamber 10 to a bottom end of the contaminants-blocking member 60. Further, the outlet 54 of the entering passage 55 may be formed to be downward inclined toward the bottom surface 12 of the first chamber 10 to discharge the outside air to the bottom surface 12 of the first chamber 10 so that the entering outside air forms a downwardly whirling air current.

Figure 5:
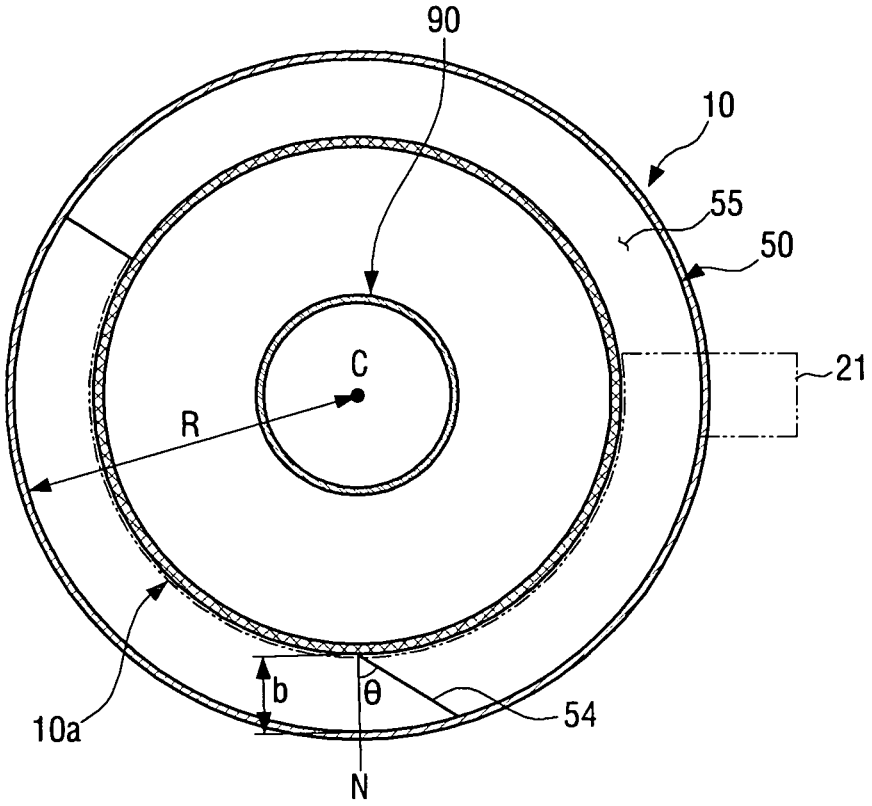
FIG. 5 is a sectional view briefly illustrating the cyclone dust collecting apparatus taken along a line 5-5 in FIG. 3 for explaining an outlet of an entering passage of the cyclone dust collecting apparatus of FIG. 1.

FIG. 5 is a sectional view schematically illustrating the cyclone dust collecting apparatus taken along a line 5-5 in FIG. 3 for showing the outlet of the entering passage of the cyclone dust collecting apparatus.

Referring to FIG. 5, the outlet 54 of the entering passage 55, namely, an end toward the first chamber 10 of the entering passage 55 forming an inlet of the first chamber 10, which is a cyclone space, has a width b. Here, the width b is referred to a distance measured along a normal N of the first chamber 10 at an end point of the outlet 54 of the entering passage 55. The normal N of the first chamber 10 is referred to a straight line perpendicular to a side wall 10*a* of the first chamber 10, namely, a straight line toward a center C of the first chamber 10. At this time, the width b of the outlet 54 of the entering passage 55 may satisfy a following formula 1.

$$0<b\ R/2 \quad (1)$$

Here, b is the width of the outlet 54 of the entering passage 55, and R is a radius of the first chamber 10.

In other words, the width of the outlet 54 of the entering passage 55 may be the same as or smaller than ½ of the radius R of the first chamber 10. In this embodiment, when the width b of the outlet 54 of the entering passage 55 is approximately ⅓ of the radius R of the first chamber 10, the cyclone dust collecting apparatus 1 has a maximum efficiency. If the width b of the outlet 54 of the entering passage 55 is larger than ½ of the radius R of the first chamber 10, water discharged from the outlet 54 of the entering passage 55 may be flowed into the second chamber 40 by an upwardly whirling air current generated in a center portion of the first chamber 10.

Also, the outlet 54 of the entering passage 55 may be formed to be inclined with respect to the normal N of the first chamber 10. An inclined direction of the outlet 54 may be formed so that an inclined surface of the outlet 54 faces the side wall 10*a* of the first chamber 10 as illustrated in FIG. 5. If the outlet 54 of the entering passage 55 is formed at a predetermined incline a to face the side wall 10*a* of the first chamber 10, it may be minimized that water entering the first chamber 10 through the outlet 54 of the entering passage 55 with the outside air is substantially affected by the upwardly whirling air current generated in the center of the first chamber 10. As a result, the water entering the first chamber 10 may be prevented from flowing to the second chamber 40. At this time, the inclined angle θ of the outlet 54 of the entering passage 55 may be in a range between approximate 10 degrees and approximate 80 degrees.

Referring to FIGS. 2 to 4, the entering passage 55 according to this embodiment is formed in a helical insert 50 disposed inside the upper case 20. The helical insert 50 includes an insert body 51 and a guide member 52. The insert body 51 may be formed in a hollow cylindrical shape and have an inner diameter smaller than an inner diameter of the lower portion 30 of the upper case 20. The guide member 52 may be formed in a helical shape winding an outer-circumferential-surface of the insert body 51 more than one turn. The guide member 52 may include a first guide 52*a* and a second guide 52*b* that are formed in a band shape and disposed parallel to and space apart from each other. Therefore, when the helical insert 50 is inserted in the lower portion 30 of the upper case 20, a side wall 30*a* of the lower portion 30 of the upper case 20 forms an outer wall of the entering passage 55, the insert body 51 forms an inner wall of the entering passage 55, the first guide 52*a* forms a top wall of the entering passage 55, and the second guide 52*b* forms a bottom wall of the entering passage 55. In other words, when the helical insert 50 is inserted in the lower portion 30 of the upper case 20, the lower portion 30 of the upper case 20 and the helical insert 50 form the entering passage 55 having a rectangular pipe shape. The helical insert 50 illustrated in FIG. 4 has the first guide 52*a* a portion of which is removed. At this time, since a top surface 30*b* of the lower portion 30 of the upper case 20 can perform a function of the first guide 52*a*, the portion of the first guide 52*a* is removed. Then, when the lower portion 30 of the upper case 20 is coupled to the top end of the lower case 10, the entering passage 55 locates above the first chamber 10.

In the above description, the entering passage 55 is formed to use the helical insert 50 and the upper case 20. Alternatively, the entering passage 55 may be formed to bend a square pipe or a round pipe in a helical shape.

The second chamber 40 may be formed at a position higher than that of the outlet 54 of the entering passage 55 above the first chamber 10 for air entering from the first chamber 10 to whirl therein. Since the second chamber 40 locates above the first chamber 10, the second chamber 40 is little affected by a rotating movement inside the first chamber 10. The second chamber 40 may be formed to have a diameter the same as or smaller than that of an imaginary cylinder (for example, the insert body 51 of the helical insert 50 in this embodiment) around which the entering passage 55 is wound. Referring to FIG. 3, the second chamber 40 of the embodiment is formed by an upper portion of the upper case 20. The upper portion 40 of the upper case 20 has an inner diameter corresponding to the insert body 51 of the helical insert 50 and projects a predetermined height from the top surface 30*b* of the lower portion 30. In FIGS. 1 and 3, reference numerals 40*a* and 40*b* refer to a side surface and a top surface of the upper portion 40, respectively.

The contaminants-blocking member 60 may be disposed at the center of the first chamber 10 and spaced a predetermined distance H3 apart from the bottom surface 12 of the first chamber 10 to prevent contaminants and water separated in the first chamber 10 from moving to the second chamber 40. The first chamber 10 is in fluid communication with the second chamber 40 through an annular opening 61 formed around the contaminants-blocking member 60 so that air in the first chamber 10 can move into the second chamber 40. For this, the contaminants-blocking member 60, as illustrated in FIG. 3, may be formed to have an outer diameter d of a dimension smaller than that of the inner diameter D of the insert body 51 of the helical insert 50. Alternatively, when the contaminants-blocking member 60 is formed to have an outer diameter d the same as or larger than that of the second chamber 40, a bottom end of the second chamber 40 may be formed to be spaced apart from the contaminants-blocking member 60 (see FIG. 7). Also, the contaminants-blocking member 60 may be formed in a shape similar to a lampshade or a skirt inclined downwardly.

The grill 70 may be disposed inside the second chamber 40 and is in fluid communication with an air discharging port 29. Accordingly, air entering the second chamber 40 is discharged to the air discharging port 29 through the grill 70. The grill 70 may be formed in a hollow cylindrical shape. A plurality of fine holes 71 are formed on the surface of the grill 70. A second cyclone 80 also may be disposed inside the grill 70 to further separate contaminants and water from air entering an inside of the grill 70 through the fine holes 71 of the grill 70. Accordingly, when the air entering from the second chamber 40 to the inside of the grill 70 passes the second cyclone 80, fine contaminants and water are separated from the air, and then the air is discharged to the air discharging port 29. The contaminants and water separated in the second cyclone 80 are collected in an inner contaminant receptacle 90 disposed below the second cyclone 80. The inner contaminant receptacle 90 is disposed at a center of the lower case 10 and is formed substantially in a funnel shape having a diameter increasing upward to support the second cyclone 80 and the grill 70. A supporting plate 91 supporting the second cyclone 80 is disposed at a top end of the inner contaminant receptacle 90. The contaminants-blocking member 60, as illustrated in FIG. 3, is disposed at an upper portion of the inner contaminant receptacle 90. The contaminants-blocking member 60 may be disposed so that a height H3 from the bottom surface 12 of the lower case 10 to the contaminants-blocking member 60 is the same as or higher than the height H2 from the bottom surface 12 of the lower case 10 to the bottom end of the outlet 54 of the entering passage 55.

The second cyclone 80 may be formed in a multi-cyclone having a plurality of cyclone bodies 81. Referring to FIG. 2, the second cyclone 80 according to this embodiment includes four cyclone bodies 81. Accordingly, the supporting plate 91 of the inner contaminant receptacle 90 also has four supporting holes 92 in which the four cyclone bodies 81 are inserted. Here, even though the second cyclone 80 according to an embodiment has four cyclone bodies 81, this is for illustrative purposes only. The second cyclone 80 may have three or less cyclone bodies 81 or five or more cyclone bodies 81 as desired. Each of the cyclone bodies 81 may have an upper body 81*a* in a hollow cylindrical shape and a lower body 81*b* that is extended from a bottom end of the upper body 81*a* and has an approximate hollow truncated cone shape. Also, at a side surface 82 of the upper body 81*a* of the cyclone body 81 is formed an entrance which air having passed through the grill 70 enters. The lower body 81*b* projects inside the inner contaminant receptacle 90 (see FIG. 3). Accordingly, contaminants and water separated in the cyclone bodies 81 are discharged into the inner contaminant receptacle 90 through a contaminant-discharging opening 83 formed at the bottom end of each of the lower bodies 81*b*. An air-discharging pipe 84 is disposed at a center of the upper body 81*a* of the cyclone body 81. In this embodiment, the air-discharging pipe 84 is fixed to a top surface 40*b* of the upper portion 40 of the upper case 20.

In this embodiment, the upper case 20 is formed in a single body having the lower portion 30 that covers the lower case 10 and in which the helical insert 50 is disposed and the upper portion 40 forming the second chamber in which the grill 70 is disposed. Alternatively, each of the upper portion 40 and the lower portion 30 is formed in a separate part, and then the upper portion 40 and the lower portion 30 are assembled to form the upper case 20.

Figure 6:
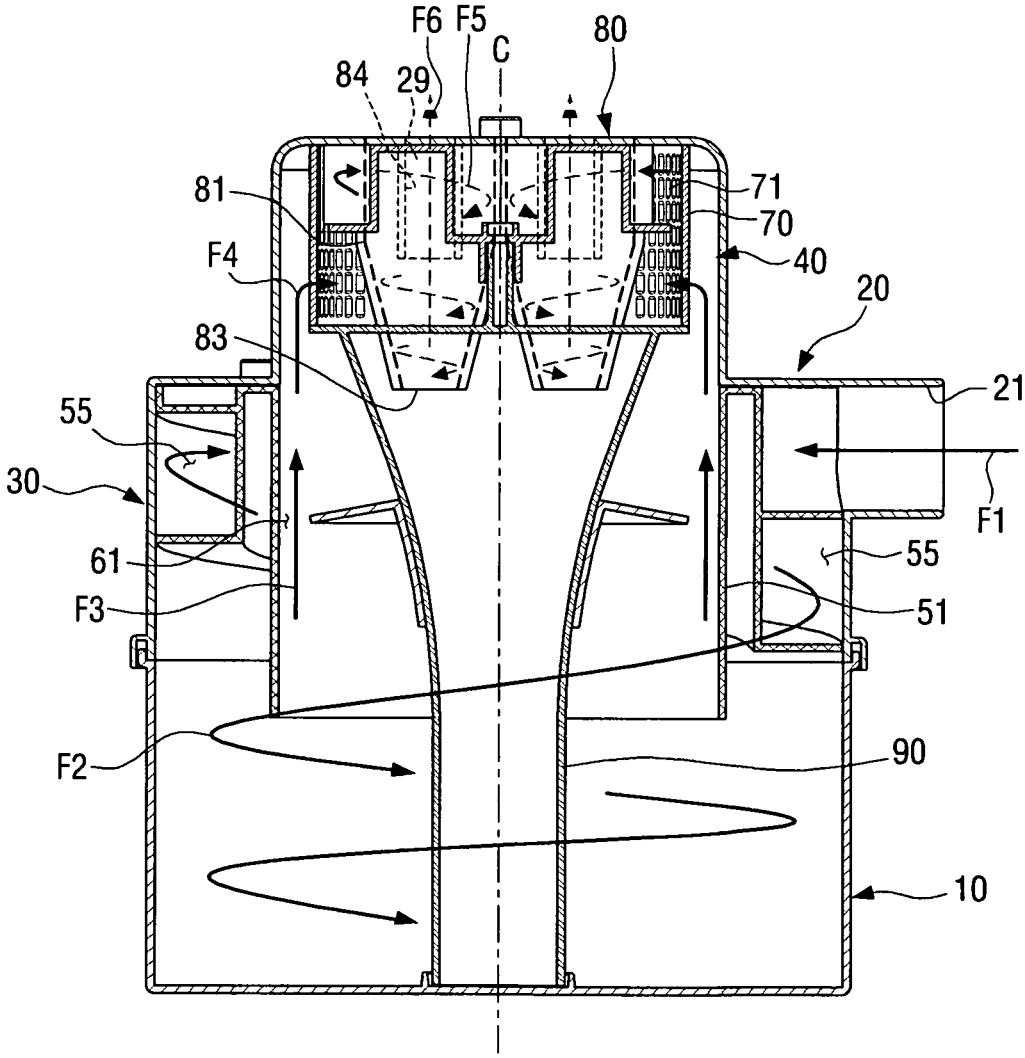
FIG. 6 is a sectional view for explaining an air current in the cyclone dust collecting apparatus of FIG. 1.

Hereinafter, operation of the cyclone dust collecting apparatus 1 for a vacuum cleaner according to an embodiment having the above-described structure will be described with reference to FIG. 6.

Outer air including contaminants and water sucked from a surface to be cleaned enters the entering passage 55 through the entering pipe 21 of the upper case 20 (arrow F1).

Since the entering passage 55 is formed in a pipe shape being wound one and more turn, while the outer air passes through the entering passage 55, the whirling force of the outer air is increased, and then some water of the outer air is attached to the inner surface of the entering passage 55 and separated from the outer air. The water attached on the inner surface of the entering passage 55 flows along the downwardly inclined entering passage 55, and falls into and is collected in the lower case 10.

The outer air passed through the entering passage 55 forms a downwardly whirling air current in the lower case 10 (arrow F2). Then contaminants and water are separated from the outer air by the centrifugal force operating upon the downwardly whirling air current and are collected on the bottom surface 12 of the lower case 10.

Air from which contaminants and water have been removed by the centrifugal force enters the second chamber 40, namely, the upper portion 40 of the upper case 20 (arrow F3) through the annular opening 61 between the contaminants-blocking member 60 and the inner surface of the insert body 51 of the helical insert 50. The air entered the second chamber 40 passes through the fine holes 71 and enters the inside of the grill 70 (arrow F4). When the air enters the inside of the grill 70 through the fine holes 71, contaminants and water remaining in the air are crashed against the grill 70, and then are removed one more time. The removed contaminants and water flow along a top surface of the contaminants blocking member 60 and are collected into the lower case 10.

The air having entered the inside of the grill 70 enters each of the four cyclone bodies 81 of the second cyclone 80 and forms a whirling air current therein (arrow F5). While the air whirls in the cyclone body 81, contaminants and water remaining in the air are removed from the air by the centrifugal force. The contaminants and water removed from the air are discharged into the inner contaminants receptacle 90 through the contaminant-discharging opening 83 of the bottom end of the cyclone body 81. Cleaned air is discharged outside the cyclone dust collecting apparatus 1 through the air-discharging pipe 84 (arrow F6).

With the cyclone dust collecting apparatus 1 according to an embodiment having the structure as described above, since the entering passage 55 is wound 360 degrees and more, the second chamber 40 with the air-discharging port 29 is configured independently from the first chamber 10, and a position through which air is discharged from the first chamber 10 is the same level as or higher than that of the inlet 53 through which the air enters the first chamber 10 based on an advancing direction of the air current, water separating efficiency is higher than that of the conventional cyclone dust collecting apparatus. According to the results of performed tests, when water of 1000 cc is sucked, the water separating efficiency of the conventional cyclone dust collecting apparatus is approximately 80% or less, but the water separating efficiency of the cyclone dust collecting apparatus according to an embodiment is approximately 98.6%.

Figure 7:
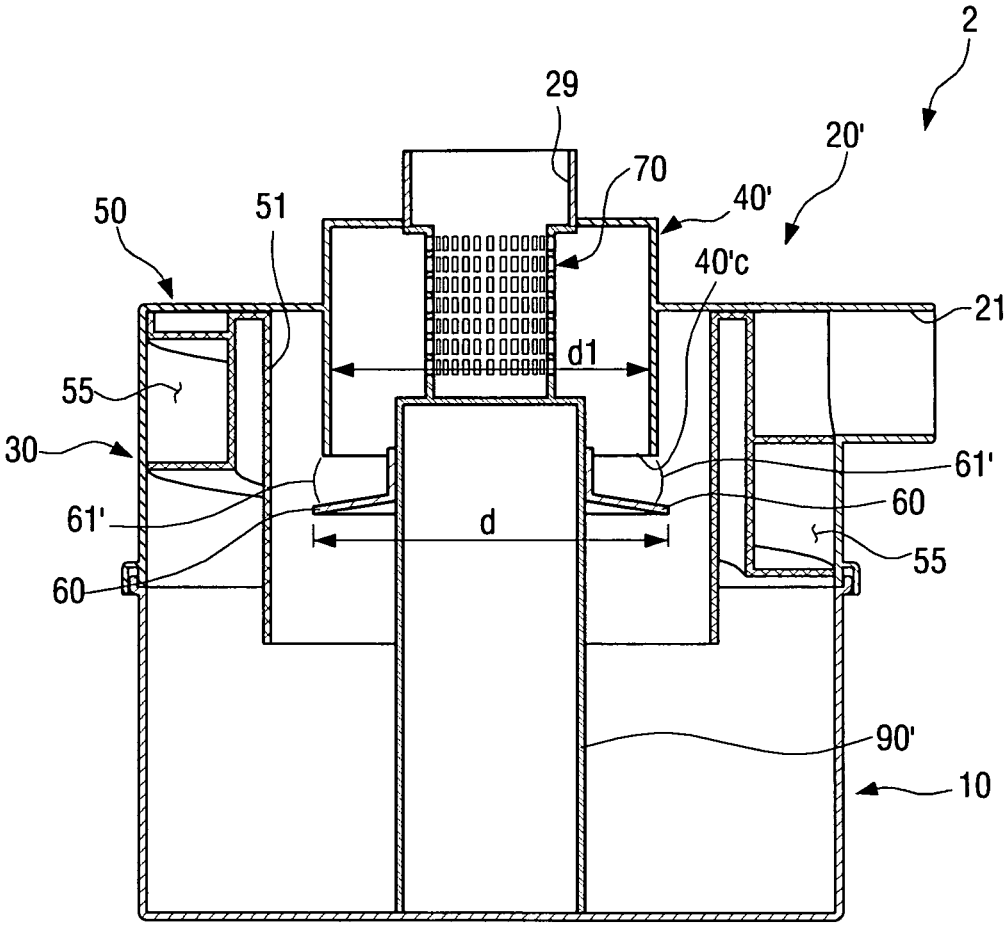
FIG. 7 is a sectional view illustrating a cyclone dust collecting apparatus for a vacuum cleaner according to another embodiment.

FIG. 7 is a sectional view schematically illustrating a cyclone dust collecting apparatus 2 for a vacuum cleaner according to another embodiment.

Referring to FIG. 7, the cyclone dust collecting apparatus 2 according to an embodiment may include a first chamber 10, a second chamber 20', an entering passage 55, a contaminants-blocking member 60, and a grill 70.

The first chamber 10, the entering passage 55, the contaminants-blocking member 60, and the grill 70 of the cyclone dust collecting apparatus 2 illustrated in FIG. 7 are the same as or similar to those of the cyclone dust collecting apparatus 1 according to an embodiment as described above. Therefore, explanations thereof will be omitted.

The second chamber 40' is formed to have an inner diameter smaller than the inner diameter of the insert body 51 of the helical insert 50 forming the entering passage 55. In this embodiment, the inner diameter d1 of the second chamber 40 is not larger than the outer diameter d of the contaminants-blocking member 60, and a bottom end 40'*c* of the second chamber 40' is spaced apart predetermined distance from the contaminants-blocking member 60. Therefore, air of the first chamber 10 enters the second chamber 40 through an annular opening 61' between the contaminants-blocking member 60 and the bottom end 40'*c* of the second chamber 40'.

Also, the cyclone dust collecting apparatus 2 according to an embodiment is different from the cyclone dust collecting apparatus 1 according to an embodiment as described above in that the second cyclone 80 (see FIG. 3) is not disposed inside the grill 70. Therefore, instead of the inner contaminants receptacle 90, a supporting member 90' supporting the contaminants-blocking member 60 and the grill 70, is disposed at a center of the lower case 10.

Operation of the cyclone dust collecting apparatus 2 according to this embodiment is the same as that of the cyclone dust collecting apparatus 1 according to the embodiment as described above except that the second cyclone 80 further removes contaminants and water. Therefore, a detailed explanation thereof will be omitted.

Figure 8:
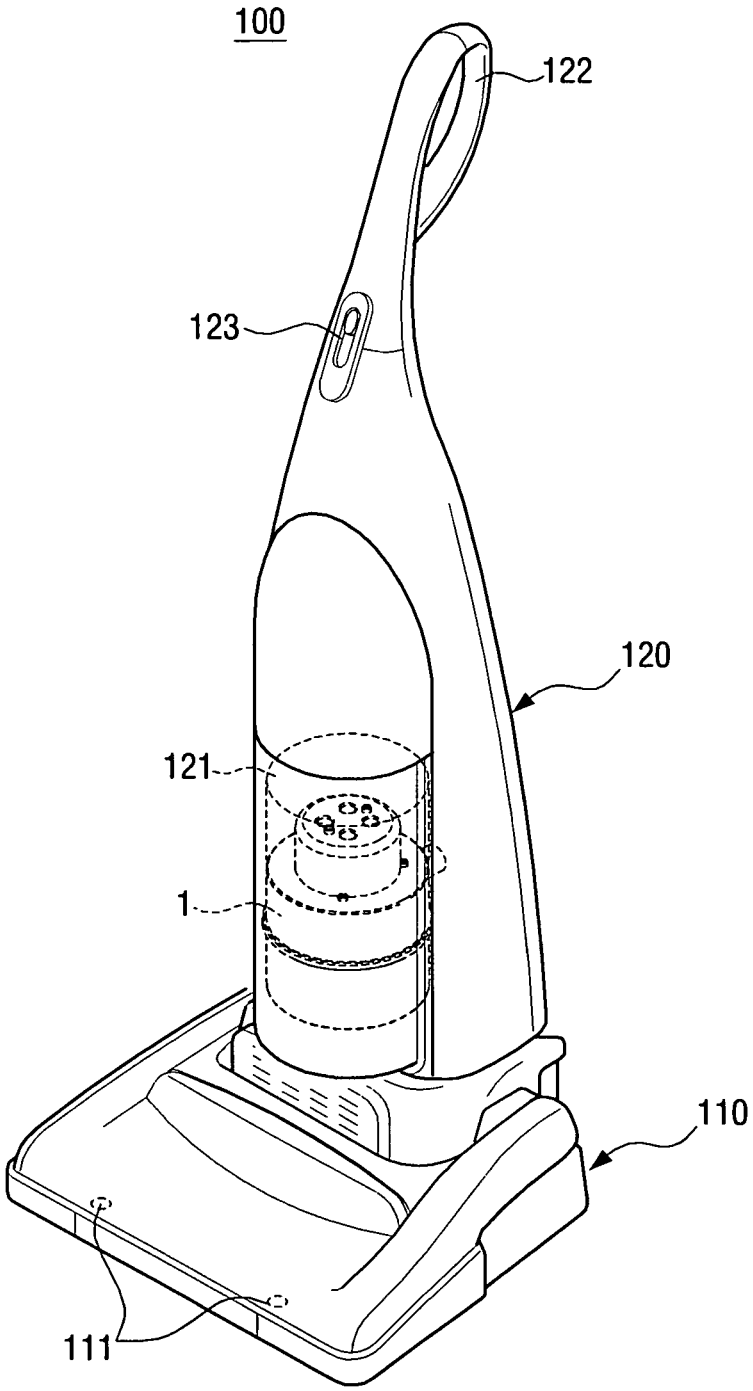
FIG. 8 is a perspective view illustrating an upright type vacuum cleaner having a cyclone dust collecting apparatus according to an embodiment.
Figure 9:
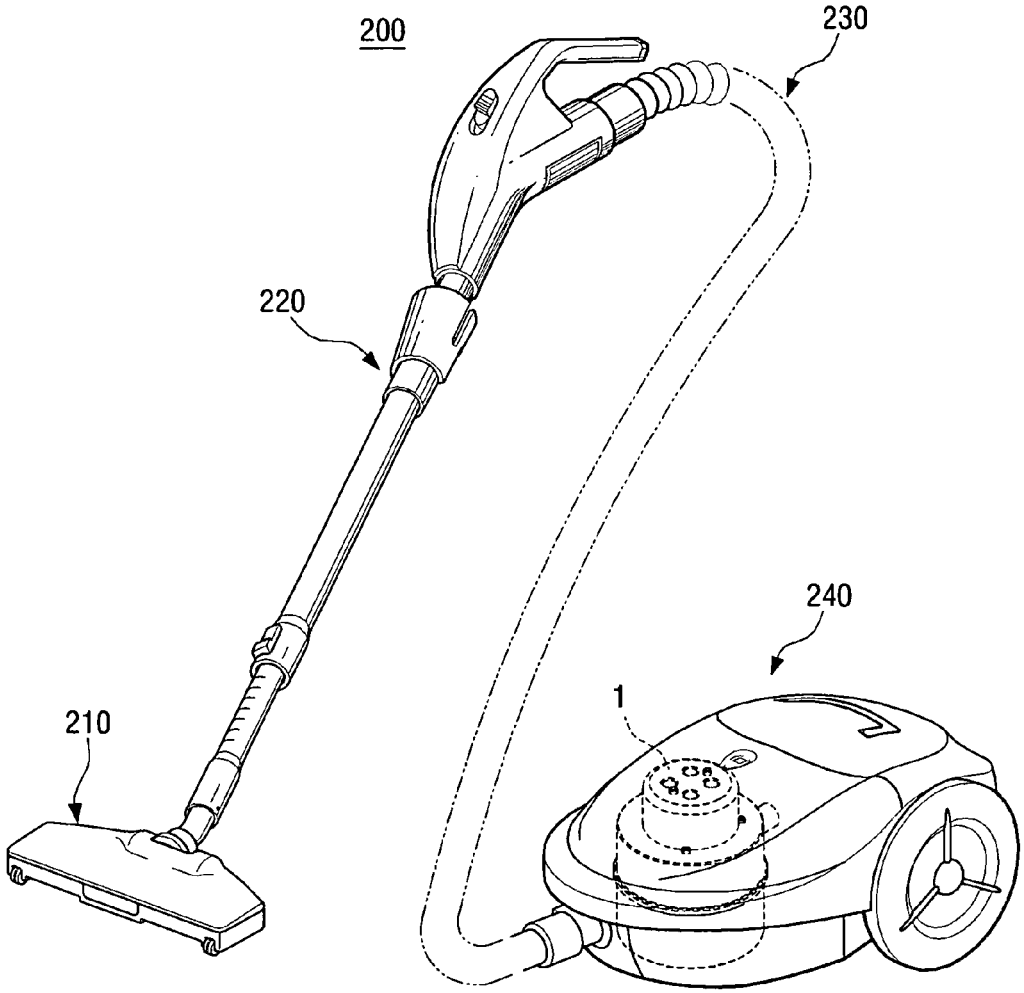
FIG. 9 is a perspective view illustrating a canister type vacuum cleaner having a cyclone dust collecting apparatus according to an embodiment.

FIGS. 8 and 9 are perspective views illustrating vacuum cleaners 100 and 200 having a cyclone dust collecting apparatus 1 according to an embodiment.

Referring to FIG. 8, an upright type vacuum cleaner 100 can perform dry and wet cleaning, and includes a nozzle assembly 110 and a cleaner body 120.

On a bottom surface of the nozzle assembly 110 facing a surface to be cleaned is formed a suction port (not illustrated) through which contaminants and water are sucked. At a front portion of the nozzle assembly 110 is disposed a water spraying nozzle 111 that can spray water to the surface to be cleaned.

In the cleaner body 120 are disposed the cyclone dust collecting apparatus 1 according to an embodiment and a motor assembly 121 to generate a suction force. Further, a water tank (not illustrated) to store water supplied to the water spraying nozzle 111 may be disposed in the cleaner body 120. An entering pipe of the cyclone dust collecting apparatus 1 is in fluid communication with the suction port of the nozzle assembly 110 by a connecting pipe (not illustrated). An air discharging port 29 of the cyclone dust collecting apparatus 1 is in fluid communication with the motor assembly 121 by a connecting duct (not illustrated). Further, a handle 122 and a switch 123 to turn on or off the motor assembly 121 and the water spraying nozzle 111 are formed on an upper portion of the cleaner body 120.

Accordingly, when performing a wet cleaning, a user operates the switch 123 to open the water spraying nozzle 111, thereby spraying water onto a surface to be cleaned. After that, the user turns on the motor assembly 121 and holds the handle 122 to move the nozzle assembly 110. Then contaminants and water are sucked with outer air from the surface to be cleaned into the suction port of the nozzle assembly 110. The sucked outer air is entered the cyclone dust collecting apparatus 1 through the entering pipe. The contaminants and water are separated from the outer air by the cyclone dust collecting apparatus 1. Operation in that the cyclone dust collecting apparatus 1 separates contaminants and water from the entering outer air is described above; therefore, a detailed explanation thereof will be omitted.

Air from which contaminants and water are removed in the cyclone dust collecting apparatus 1 is moved to the motor assembly 121 through the connecting duct and then is discharged outside the cleaner body 120.

Even when performing dry cleaning not using water, the cyclone dust collecting apparatus 1 according to an embodiment removes contaminants and water by a cyclone method; therefore, the cyclone dust collecting apparatus 1 can efficiently separate contaminants and water from outer air.

Referring FIG. 9, a canister type vacuum cleaner 200 may include a suction nozzle 210, an extension pipe 220, a flexible hose 230, and a cleaner body 240.

In the cleaner body 240 are disposed the cyclone dust collecting apparatus 1 according to an embodiment and a motor assembly (not illustrated) to generate a suction force.

When the motor assembly operates, a suction force is generated so that contaminants are sucked with outer air from a surface to be cleaned through the suction nozzle 210. At this time, if water is on the surface to be cleaned, the water is also sucked with the contaminants and outer air. The water sucked with the air and contaminants into the suction nozzle 210 is entered the cyclone dust collecting apparatus 1 through the extension pipe 220 and the flexible hose 230. The contaminants and water are separated from the outer air by the cyclone dust collecting apparatus 1. Operation in that the cyclone dust collecting apparatus 1 separates contaminants and water from the entering outer air is described above; therefore, a detailed explanation thereof will be omitted.

A vacuum cleaner using a cyclone dust collecting apparatus according to an embodiment can perform a cleaning regardless of dry cleaning and wet cleaning without replacing the cyclone dust collecting apparatus; therefore, it is convenient for a user to use the vacuum cleaner.

While the embodiments have been described, additional variations and modifications of the embodiments may occur to those skilled in the art once they learn of the basic inventive concepts. Therefore, it is intended that the appended claims shall be construed to include both the above embodiments and all such variations and modifications that fall within the spirit and scope of the invention.

What is claimed is:

1. A cyclone dust collecting apparatus for a vacuum cleaner comprising:

a first chamber;

an entering passage disposed above the first chamber, the entering passage guiding outer air to form a downwardly whirling air current in the first chamber;

a second chamber formed at a position higher than that of an outlet of the entering passage above the first chamber, the second chamber in which the outer air entering from the first chamber whirls;

a contaminants-blocking member disposed at a center of the first chamber and spaced apart from a bottom surface of the first chamber to prevent contaminants and water separated in the first chamber from moving into the second chamber; and a grill disposed inside the second chamber to be in fluid communication with an air discharging port through which clean air is discharged, wherein the entering passage is formed in a helical pipe shape wound at least one turn along the first chamber, and wherein the outlet of the entering passage is formed at a position that is lower than that of an inlet of the entering passage and that is the same as or lower than that of the contaminants-blocking member, wherein the first chamber is formed in a lower case to have a cylindrical shape, and the second chamber is formed in an upper case to be coupled to a top portion of the lower case, and wherein the entering passage is formed in a helical insert that is disposed inside the upper case, and the helical insert comprises a hollow insert body having an inner diameter smaller than that of the upper case and a guiding member disposed in a helical shape on an outer circumferential surface of the insert body.

2. The cyclone dust collecting apparatus of claim 1, wherein the entering passage is wound approximately one-and-half turn along a circumference of the first chamber.

3. The cyclone dust collecting apparatus of claim 1, wherein the first chamber and the second chamber are in fluid communication with each other through an annular opening formed around the contaminants-blocking member.

4. The cyclone dust collecting apparatus of claim 1, wherein the outlet of the entering passage is inclined to discharge the outer air toward the bottom surface of the first chamber.

5. The cyclone dust collecting apparatus of claim claim 1, wherein the contaminants-blocking member is supported by a supporting member disposed at a center of the lower case.

6. The cyclone dust collecting apparatus of claim 1, further comprising:

a second cyclone disposed inside the grill; and an inner contaminants chamber disposed below the grill in the first chamber, the inner contaminants chamber to collect contaminants and water discharged from the second cyclone.

7. The cyclone dust collecting apparatus of claim 6, wherein the contaminants-blocking member is disposed at the inner contaminants chamber.

8. The cyclone dust collecting apparatus of claim 6, wherein the second cyclone comprises a plurality of cyclone bodies.

9. The cyclone dust collecting apparatus of claim 1, wherein the contaminants-blocking member is formed in a skirt shape downward inclined toward the bottom surface of the first chamber.

10. The cyclone dust collecting apparatus of claim 1, wherein a width of the outlet of the entering passage is equal to or smaller than ½ of a radius of the first chamber.

11. The cyclone dust collecting apparatus of claim 1, wherein the outlet of the entering passage is inclined to face a side wall of the first chamber.

12. A vacuum cleaner, comprising:

a cyclone dust collecting apparatus comprising;

a first chamber;

an entering passage disposed above the first chamber, the entering passage guiding outer air to form a downwardly whirling air current in the first chamber;

a second chamber formed at a position higher than that of an outlet of the entering passage above the first chamber, the second chamber in which the outer air entering from the first chamber whirls;

a contaminants-blocking member disposed at a center of the first chamber and spaced apart from a bottom surface of the first chamber to prevent contaminants and water separated in the first chamber from moving into the second chamber; and a grill disposed inside the second chamber to be in fluid communication with an air discharging port through which clean air is discharged, wherein the entering passage is formed in a helical pipe shape wound at least one turn along the first chamber, and wherein the outlet of the entering passage is formed at a position that is lower than that of an inlet of the entering passage and that is the same as or lower than that of the contaminants-blocking member, wherein the first chamber is formed in a lower case to have a cylindrical shape, and the second chamber is formed in an upper case to be coupled to a top portion of the lower case, and wherein the entering passage is formed in a helical insert that is disposed inside the upper case, and the helical insert comprises a hollow insert body having an inner diameter smaller than that of the upper case and a guiding member disposed in a helical shape on an outer circumferential surface of the insert body.

13. The cyclone dust collecting apparatus of claim 1, wherein a width of the outlet of the entering passage is approximately ⅓ of a radius of the first chamber.

14. The cyclone dust collecting apparatus of claim 11, wherein the outlet of the entering passage is inclined at a predetermined angle to face the side wall of the first chamber and to minimize water entering the first chamber through the outlet of the entering passage with the outside air.

15. The cyclone dust collecting apparatus of claim 1, wherein the contaminants-blocking member is formed to have an outer diameter smaller than the inner diameter of the hollow insert body of the helical insert.

16. The cyclone dust collecting apparatus of claim 1, wherein the grill is formed in a hollow cylindrical shape and includes a plurality of fine holes formed on the surface of the grill.

17. The cyclone dust collecting apparatus of claim 8, wherein each of the plurality of cyclone bodies includes an upper body in a hollow cylindrical shape and a lower body that is extended from a bottom end of the upper body and has an approximate hollow truncated cone shape.

18. The cyclone dust collecting apparatus of claim 1, further comprising:

a second cyclone disposed inside the grill; and an inner contaminant receptacle disposed below the second cyclone, wherein the inner contaminant receptacle is disposed at a center of the first chamber and is formed in a funnel shape having a diameter increasing upward to support the second cyclone and the grill, and a supporting plate to support the second cyclone is disposed at a top end of the inner contaminant receptacle.

19. The cyclone dust collecting apparatus of claim 5, wherein the contaminants-blocking member is formed to have an outer diameter equal to or larger than that of the second chamber, a bottom end of the second chamber is formed to be spaced apart from the contaminants-blocking member.

* * * * *

UNITED STATES PATENT AND TRADEMARK OFFICE

CERTIFICATE OF CORRECTION

PATENT NO. : 8,914,941 B2
APPLICATION NO. : 13/067415
DATED : December 23, 2014
INVENTOR(S) : Min ha Kim et al.

It is certified that error appears in the above-identified patent and that said Letters Patent is hereby corrected as shown below:

Title Page, item (30), (Foreign Application Priority Data), Column 1 (Below Prior Publication on Data), Line 1:

Below "May 17, 2012" insert --Foreign Application Priority Data November 16, 2010 (KR).....10-2010-0113966--.

In the Claims

Column 10, Line 65:

In Claim 5, after "claim" delete "claim", therefor.

Column 11, Line 44:

In Claim 12, after "chamber," delete "and", therefor.

Signed and Sealed this
Fourteenth Day of July, 2015

Michelle K. Lee

Michelle K. Lee
*Director of the United States Patent and Trademark Office*